United States Patent [19]

Rozon

[11] Patent Number: 5,038,538

[45] Date of Patent: Aug. 13, 1991

[54] DOOR FRAME

[76] Inventor: David P. Rozon, 204 Castor Road, #103, P.O. Box 635, Russell, Ontario, Canada, K0A 3B0

[21] Appl. No.: 416,969

[22] Filed: Oct. 4, 1989

[30] Foreign Application Priority Data

Oct. 16, 1988 [CA] Canada ..... 579462

[51] Int. Cl.[5] ..... E06B 1/04

[52] U.S. Cl. ..... 52/213; 52/212; 52/217; 52/509

[58] Field of Search ..... 52/213, 214, 217, 509, 52/212

[56] References Cited

U.S. PATENT DOCUMENTS

| | | | |
|---|---|---|---|
| 1,926,673 | 9/1933 | Gregg | 52/214 X |
| 2,700,441 | 1/1955 | Cudini | 52/217 X |
| 3,812,621 | 5/1974 | Ragland | 52/212 X |
| 4,614,068 | 9/1986 | Bergthold | 52/214 X |
| 4,698,944 | 10/1987 | Wilkins, Jr. | 52/213 X |
| 4,873,804 | 10/1989 | Kukke | 52/213 X |

FOREIGN PATENT DOCUMENTS

| | | | |
|---|---|---|---|
| 707141 | 4/1965 | Canada | 108/73 |
| 919509 | 1/1973 | Canada | 108/73 |
| 930248 | 7/1973 | Canada | 108/68 |
| 976810 | 10/1975 | Canada | 108/73 |
| 1003698 | 1/1977 | Canada | 108/68 |
| 1034434 | 7/1978 | Canada | 108/73 |
| 1122069 | 4/1982 | Canada | 108/68 |
| 1132400 | 9/1982 | Canada | 108/68 |
| 1207192 | 7/1986 | Canada | 108/68 |
| 3619780 | 12/1987 | Fed. Rep. of Germany | . |

*Primary Examiner*—David A. Scherbel
*Assistant Examiner*—Linda J. Watson
*Attorney, Agent, or Firm*—Lorusso & Loud

[57] ABSTRACT

Improvements to a door frame are provided, comprising the provision of in a jamb member of the frame a slot that receive spaced apart legs of a hardware element, the said adapted to frictionally hold the position of the hardware element in the slot, and further comprising means for mounting the frame member to adjoining studs and headers by means of resilient elements adapted to provided angular adjustment of the members. There is further provided means to adjust the length of the frame elements by means of an extension element, which is used in combination with a decorative cover. A decorative trim element is further provided that resiliently mounts to the frame members and is adapted to press against the adjoining wall to provide a smooth junction therewith.

9 Claims, 7 Drawing Sheets

DOOR FRAME

BACKGROUND OF THE INVENTION

This invention relates to an adjustable door frame which is easily assembled, requires few parts and presents a neat and attractive appearance.

Since a large part of the construction industry is currently oriented towards mass production of housing projects or so-called "units", the need has arisen for a more versatile door frame with fully adjustable features. Due to time limitations, the framing phase of construction often leaves behind many imperfections that need to be rectified before or during the finishing process.

Prior art adjustable door frames are only adjustable as to certain aspects and require excessive hardware because of complex designs.

Canadian patent 976,810 of Stanley H. Richter, issued Oct. 28, 1975 discloses the use of elements for mounting the jamb and lintel to corresponding studs and headers in which the elements have adjusting screws which enable adjustment of the angular orientation of the jamb and lintel with respect to the studs and headers.

Canadian patent 1,132,400 of Alan C. Wendt, issued Sept. 28, 1982 and Canadian patent 1,034,434 of Jean-Claude Gregoire, issued July 11, 1978, disclose means for rapidly attaching hinge and strike plate hardware to a door frame within recesses in the jambs.

The prior art arrangements suffer the disadvantage that the mounting hardware is not retained in position in the jamb prior to being fastened with screws or other means and therefore there is little advantage gained through the use of such devices. The adjusting member disclosed in Canadian patent 976,810 is provided by a complex system that is expensive to manufacture and is complex to operate. Additionally, the prior art discloses no means for rapid attachment of decorative trim, that enables the trim to conform to irregularities in the adjacent wall.

SUMMARY OF THE INVENTION

The present invention provides an improved means for adjustably mounting the jamb and lintels, for mounting the door hardware, and for securing trim pieces.

The present invention provides a member for forming a door jamb, wherein said jamb member has a longitudinally extending slot that includes contact regions adjacent to each side of a back surface of the said slot. The slot receives spaced apart legs of a hardware element, such as a hinge or strike plate. These legs have feet with surfaces engageable with the contact surfaces, and the legs bias the feet into engagement with the surfaces in order to hold the hardware element frictionally in position in the slot.

The structural members also have grooves and tabs which cooperate with projections on decorative trim pieces whereby the trim pieces may be secured by a latching action, being simply pressed in place on the structural members.

The structural members are provided with a plurality of generally U-shaped spring members, each including a flat base adapted to lie against the inner longitudinal surface of the structural member and a pair of legs, which may be bifurcated, which are adapted to press against a stud or header The base may have two holes aligned transverse to the structural member and the structural member is secured to a stud or header by screws passing through holes in the structural member and base of the spring member. The inner-facing surfaces of the structural member may be forced into contact with the stud or joist by tightening the screws against the force of the spring member, or a small space may be left, thus enabling adjustment of the spacing between facing jambs or adjustment of the height of the lintel. Also, by tightening one screw more than the other, the angular orientation of the structural member may be adjusted, both along the longitudinal axis and, where two holes and bifurcated legs are provided in the spring members, along the transverse axis.

A second slot is provided in the structural member and provides a recess for the mounting screws. This slot is partially defined by an outer flat surface on the structural member which provides a stop for the door when it is closed. This second slot is covered by one of the trim pieces also adapted to cover the first slot and which is preferably formed of plastic such as PVC, and includes a portion extending over said flat surface to provide a cushion for the door.

The invention further provides a means for adjusting the length of a jamb or lintel, especially the lintel. According to this feature, the basic structural element is provided with an extension piece which can be slidably extended from the ends thereof. A decorative element formed of plastic, such as PVC, covers each of the extension piece and has the similar cross-sectional configuration as the basic structural element Thus, in the case of a lintel, the extension piece is pulled out until it meets the jambs and the lintel is fastened in place with screws through the spring members. Decorative elements, cut to appropriate lengths, are then put in place over the extension pieces so that the lintel appears to be one continuous piece.

BRIEF DESCRIPTION OF THE DRAWINGS

The invention will now be further described in conjunction with the accompanying drawings, in which.

DESCRIPTION OF THE PREFERRED EMBODIMENT

Figure 1:
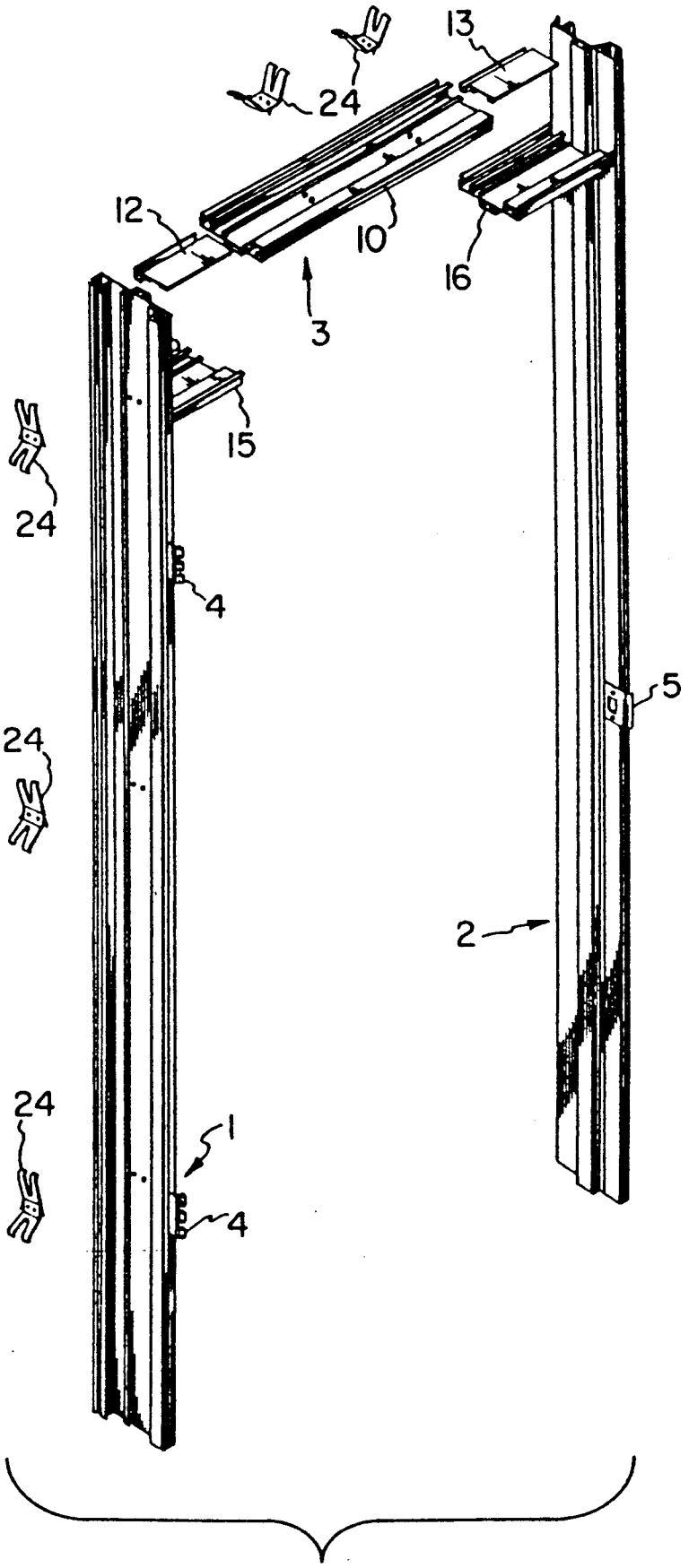
FIG. 1 is a perspective view of an adjustable door frame according to the invention.

Referring to FIG. 1, an adjustable door frame according to the invention is seen to comprise jambs 1 and 2 and a lintel 3 extending between the jambs 1 and 2. Hinges 4 are mounted on one edge of the jamb 1 and a strike plate 5 is mounted on the opposing jamb 2. A plurality of spring members 24 are attached to the inside faces of the jambs 1, 2 and lintel 3 and these enable the jambs and lintel to be adjustably mounted to studs and a header, not shown, as will be further described below.

The lintel 3 includes a central portion 10 which has the same basic structure as the jambs 1 and 2, and extension pieces 12 and 13 which are slidably received in the central portion 10. The extension pieces 12 and 13 are pulled out until they meet the jambs 1 and 2 and the lintel is then secured to the header (not shown). Decorative elements 15 and 16 are then snapped in place over the extension pieces 12 and 13. The decorative elements 15, 16 are formed of plastic, such as PVC, and have the same external configuration as the central portion 10 of the lintel.

Figure 2:
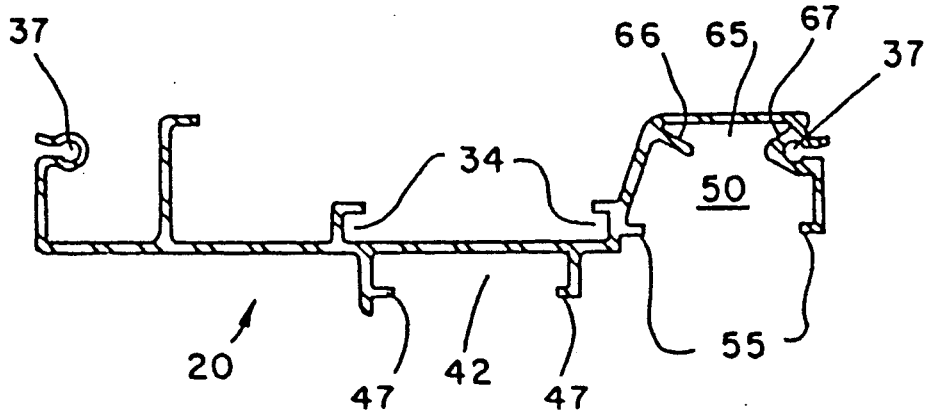
FIG. 2 is a cross-sectional view of the basic structural member used in the present invention.

The basic structural element 20 of the door frame according to the invention is illustrated in cross-section in FIG. 2. It is formed by an extrusion process, preferably of aluminum, and includes means for attaching hardware and trim pieces, as will be explained below. This one type of basic structural member 20 is used for both jambs and the central portion of the lintel.

Figure 3:
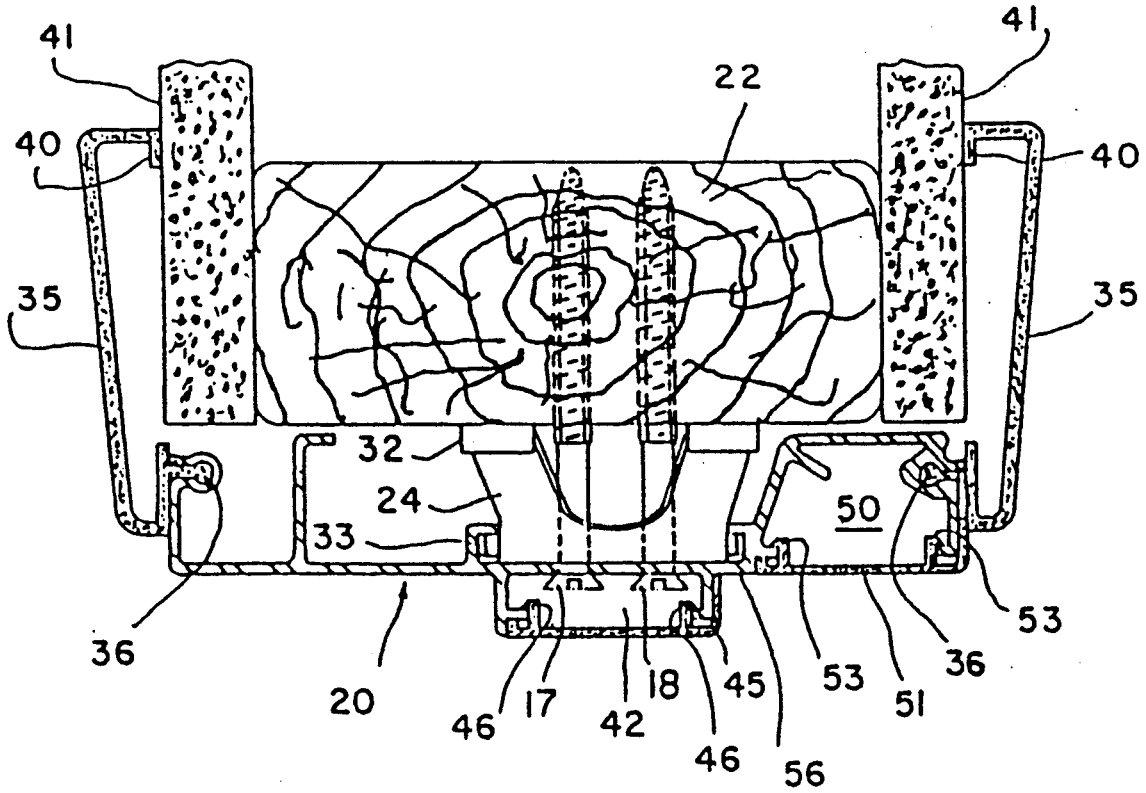
FIG. 3 is a cross-sectional view showing a jamb according to the invention attached to a stud.
Figure 9:
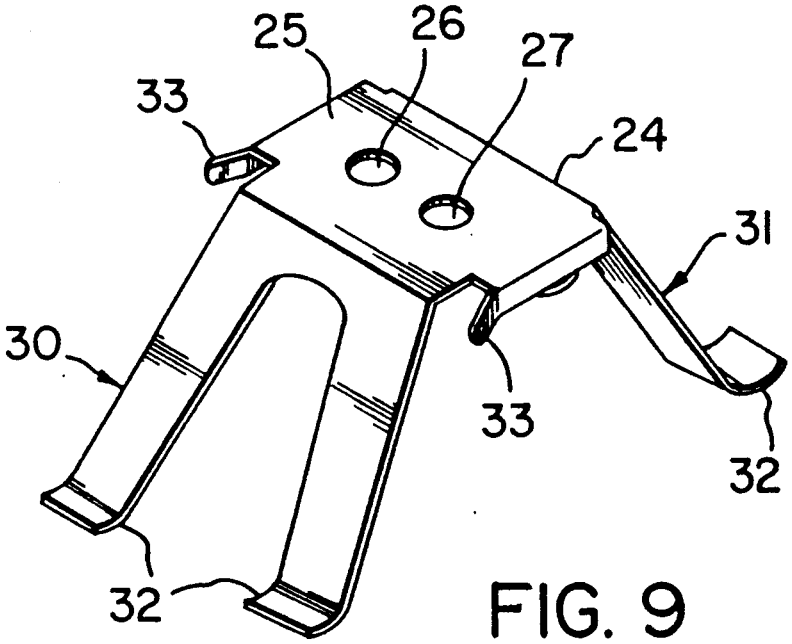
FIG. 9 is a perspective view of a spring member according to the invention.

FIG. 3 shows a basic structural member 20 attached to a stud 22 by screws 17, 18 passing through holes in the basic structural member 20 and in the U-shaped spring member 24. The spring member 24 is best seen in FIG. 9 and is seen to comprise a flat base portion 25 provided with holes 26, 27 for the attaching screws 13, 14. The spring member 24 also comprises a pair of bifurcated legs 30, 31. The ends of the legs are bent to form feet 32, which bear against the stud 22 when screws 13, 14 are tightened. The screws 13, 14 can be tightened sufficiently to cause the basic structural member 20 to press against the stud 22 or only to such an extent that a small space is left between the basic structural member 20 and the stud 22. Also, since the screws are spaced apart laterally of the longitudinal axis of the stud, one can be tightened more than the other so that the transverse angular orientation of the basic structural member can be adjusted with respect to the stud. This is useful if the stud is angularly misaligned. The spring members 24 are initially attached to the basic structural member by means of mounting tabs 33 adapted to fit within channels 34 (FIG. 2) provided in the basic structural member 20.

Obviously, the vertical orientation of a jamb is also adjustable because different spring members can be compressed different amounts. The lintel is similarly adjustable.

As shown in FIG. 3, a pair of decorative trim plates 35 are provided, each having a projecting bead 36 adapted to be press-fitted in channels 37 (FIG. 2) in the basic structural member 20. The trim plates 35 are made of resilient material such as PVC and their ends 40 press against the wall surfaces 41 and create a smooth junction therewith.

The heads of the screws 17, 18 are contained in a channel 42 in the basic structural member (see also FIG. 2) and, to hide the screw heads and provide a pleasing appearance, there is provided a trim piece 45 which has hook-like latch members 46 which engage with projections 47 (FIG. 2) on either side of channel 42.

As will be discussed below, the hinges and striker plate are secured in a channel 50 in the basic structural member 20.

Portions of channel 50 not occupied by hinges or a striker plate are closed off by a trim piece 51 (FIGS. 3 and 12) which has hook-like latch members 53 which engage with projections 55 (FIG. 2) on either side of channel 50. The thickness of trim piece 51 is such that it forms a continuous outer surface with the hinges (strike plate). It is also continuous with the adjoining surface 56 of the basic structural member 20.

Figure 4:
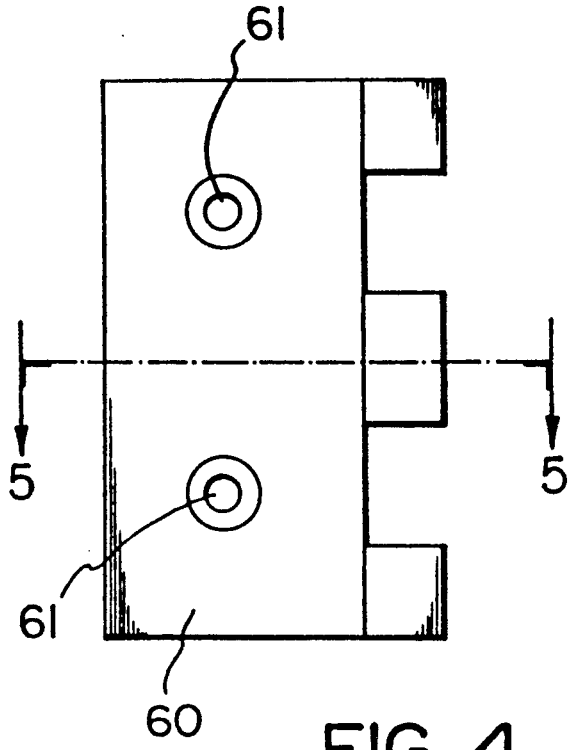
FIG. 4 is an elevational view of a hinge according to the invention.
Figure 5:
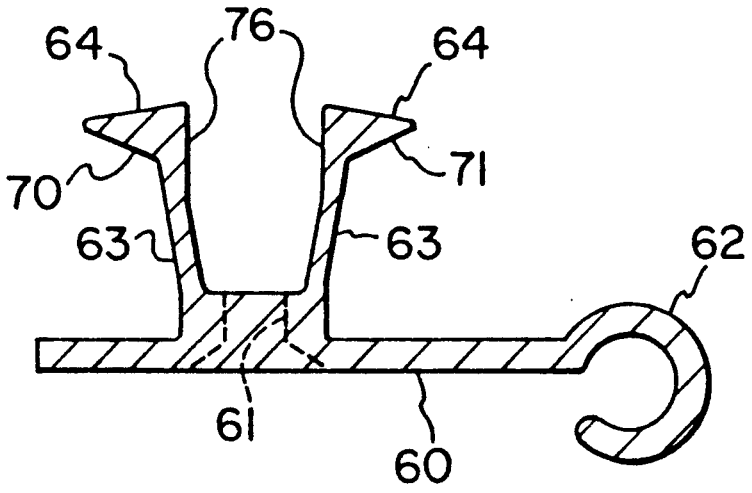
FIG. 5 is a cross-sectional view of the hinge, taken along the line 5—5 of FIG. 4.

FIGS. 4 and 5 illustrate a hinge in accordance with the present invention, or at least the stationary part of a hinge which is attached to a jamb; the movable part, attached to the door, is entirely conventional. The hinge part shown comprises a mounting plate 60 with holes 61 to accommodate mounting screws and having hinge pin receiving portions 62. Projecting from the mounting plate 60 are a pair of resilient spaced-apart legs 63 provided with feet 64. The feet 64 fit within the inner portion 65 of slot 50 in the basic structural unit 20 (FIG. 2). This inner portion 65 includes two converging inclined outer surfaces 66, 67 which match the inclined surfaces 70, 71 on the feet 64. The hinge is initially installed in the basic structural member 20 by slightly pressing together the legs 63 so that the feet 64 can slide into the inner portion 65 of the channel 50. The resiliency of the legs 63 releasably retains the hinge in position in the basic structural member so that the hinge can be slid to its desired position and released, after which it may be permanently secured with screws.

Figure 6:
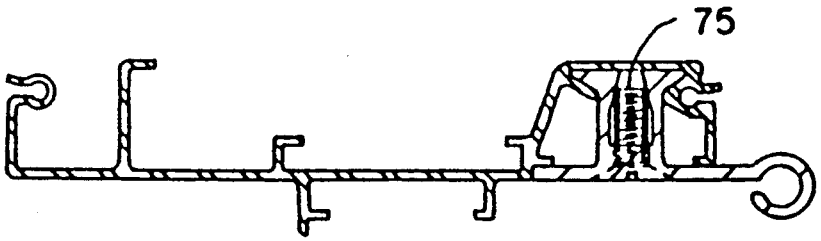
FIG. 6 is a cross-sectional view of a hinge attached to a basic structural member.

FIG. 6 shows the hinge after the screws have been inserted, one screw 75 being seen in this figure. During installation, the screw engages the sloping surfaces 76 on the legs 63 and forces them outwardly so that the feet 70, 71 are tightly secured in the inner portion 65 of slot 50 and the hinge plate is pulled into engagement with the projections 55 at the mouth of channel 50 (FIG. 2).

Figure 7:
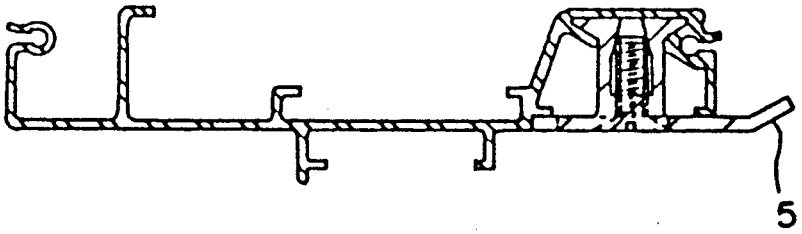
FIG. 7 is a cross-sectional view of a strike plate attached to a basic structural member.

Referring to FIG. 7, the striker plate 5 is provided with legs in the same manner as the hinges and is mounted in the slot 50 in exactly the same way.

Figure 8:
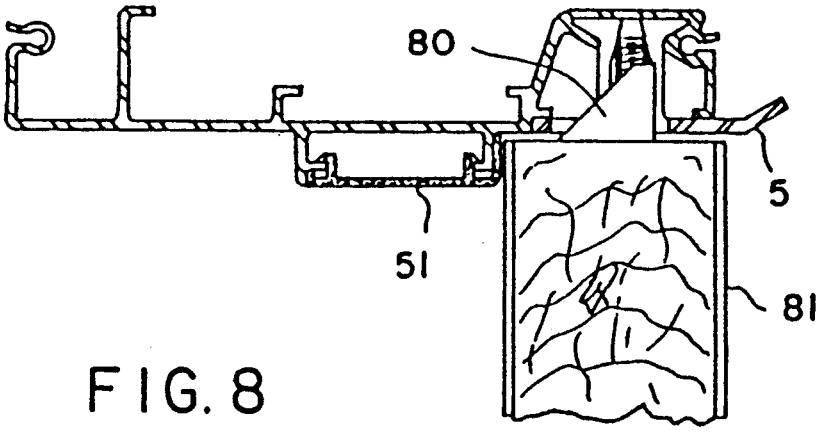
FIG. 8 is a cross-sectional view of a basic structural member and strike plate with a portion of a door and its associated latch.

FIG. 8 shows a latch 80 engaged in the striker plate 5. It can also be seen that the door 81, when closed, strikes the end of trim piece 51, which trim piece cushions the edge of the door.

Figure 12:
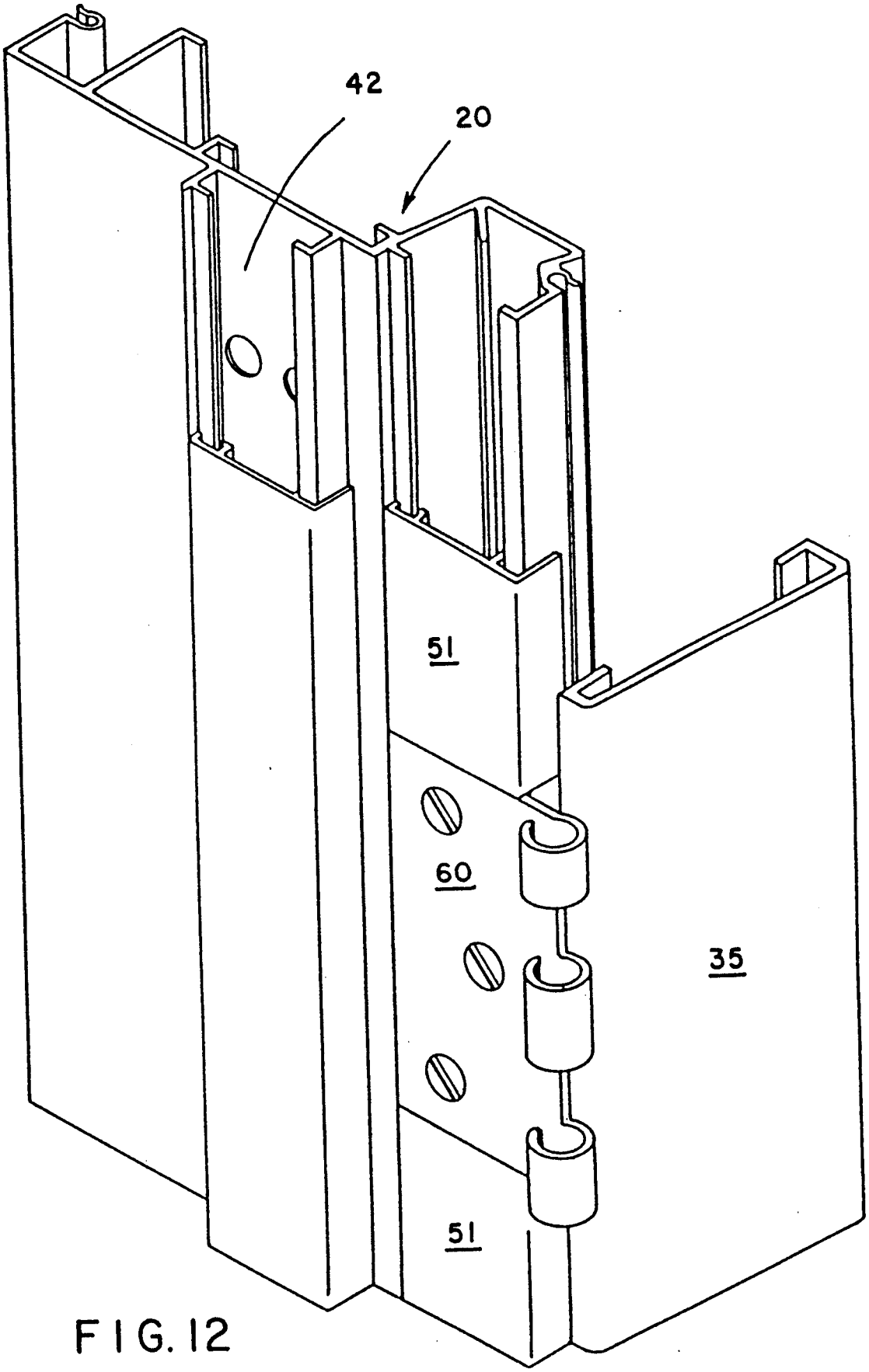
FIG. 12 is a perspective view of a jamb showing decorative trim pieces installed.

FIG. 12 is a perspective view which illustrates the neat appearance of a finished jamb. It can be seen that the trim pieces 51 have outer surfaces matching the outer surface of the mounting plate 60 of the hinge. It can also be seen that the channel 42 and the screws therein (not shown in FIG. 12) are neatly concealed. Also shown is one of the side trim pieces 35.

Figure 11:
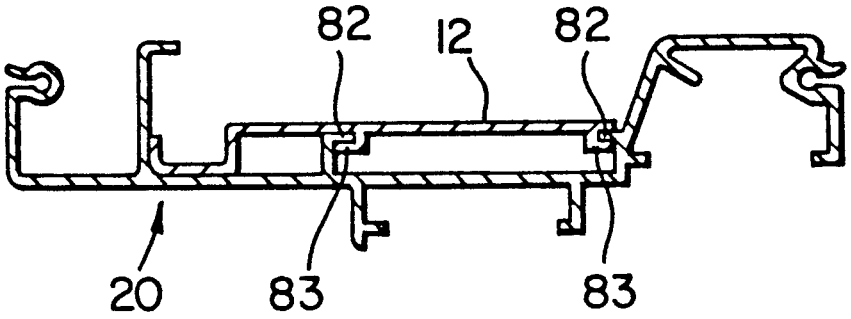
FIG. 11 is a cross-sectional view of a basic structural member with attached extension piece.
Figure 10:
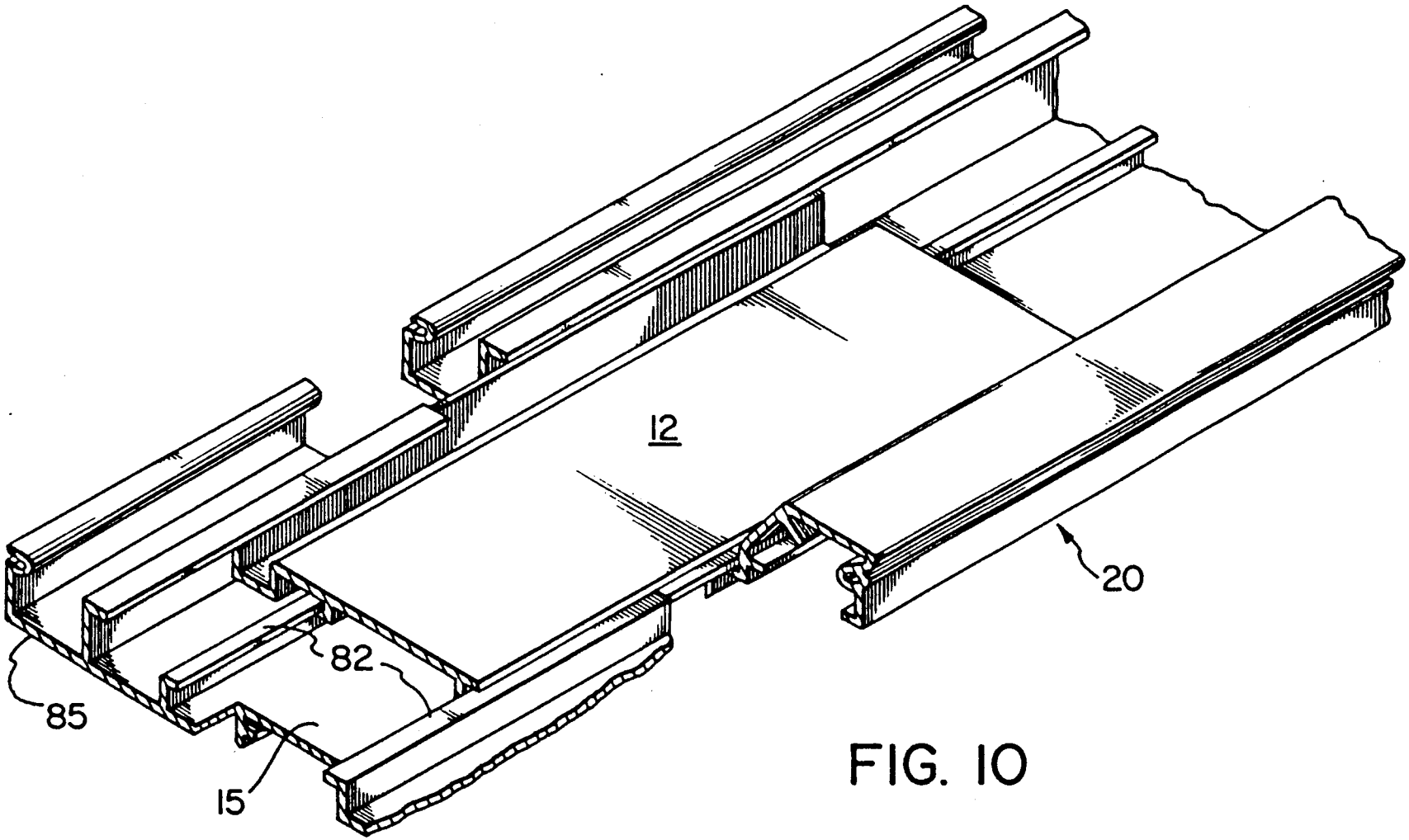
FIG. 10 is a perspective view of a lintel according to the invention and illustrating the length adjustment feature.

Referring to FIGS. 1, 10 and 11, the lintel 3 is formed of a basic structural member and two end extension pieces 12, 13 only one of which 12, is shown in FIGS. 10 and 11. The extension element 12 has longitudinally extending L-shaped projections 83 defining slots in which are received projections 82 on the basic structural member 20. Thus the extension member 12 can slide lengthwise of the basic structural member 20 but is restrained against vertical movement by the projections 82 engaged in said slots. The extension member 12 is covered by a flexible plastic trim piece 15 which has the same exterior configuration as the basic structural member 20. Being of flexible plastic, such as PVC, it is simply snapped into place over the extension piece 12 and is held in place by projections corresponding to the projections 82 on the basic structural member. The outer end 85 of the trim piece 15 is trimmed to correspond to the outside face of the jamb 1 and provide a flush junction therewith. The other end of trim piece 15 is cut square to abut the exposed end of member 20. Similar comments apply to trim piece 16.

The jambs could also be made adjustable in length in the same manner as the lintel, although it is sufficient if only the lintel is adjustable.

Although a preferred embodiment of the invention has been disclosed herein, it will be appreciated that various alterations can be made without departing from the scope of the invention as defined by the appended claims.

What is claimed is:

1. In a member for forming a door jamb, the improvement wherein said jamb member has a longitudinally extending slot having contact regions adjacent each side of a back surface of said slot; and a hardware element having spaced apart legs, said legs having feet with surfaces engageable with said contact regions and being biased into engagement therewith by said legs whereby said slot receives said spaced apart legs of the hardware element so that the hardware element is frictionally held in position in said slot.

2. The improvement as claimed in claim 1, wherein said contact regions converge outwardly towards the mouth of said slot and said feet have outer surfaces of corresponding configuration and engageable therewith.

3. The improvement as claimed in claim 2 wherein said slot has an open mouth portion bounded by flat projections and said hardware element has a plate portion engageable with said flat projections, said legs extending from said plate portion.

4. The improvement as claimed in claim 3 wherein said plate portion has a hole through it in a region between said legs for receiving a screw which forces said legs apart so that said feet firmly grip said contact regions and said plate firmly engages said flat projections.

5. The improvement as claimed in claim 4 wherein said hardware element is a stationary part of a hinge.

6. The improvement as claimed in claim 4 wherein said hardware element is a strike plate.

7. In a door frame having jamb and lintel members, means for adjustably mounting said members to an adjoining stud or header, said means comprising a plurality of generally U-shaped spring members having bifurcated legs, each spring member having a flat base adapted to lie against an inner longitudinal surface of the jamb or lintel member and resilient legs adapted to contact said stud or header, a plurality of screws passing through aligned holes in the jamb or lintel member and said flat base, said holes being aligned perpendicular to the longitudinal axis of the jam or lintel member whereby the spacing and relative angles between the jamb or lintel member and the stud of header may be adjusted in the longitudinal and transverse axes by selectively tightening or loosening said screws relative to each other.

8. In a door frame having jamb and lintel members, said members having a generally U-shaped cross-section, means to adjust the length of at least one of said members comprising an inner track element engaged within the inside of said member and adapted to slide longitudinally therein, and a decorative element having an exterior configuration generally identical to that of said member, said decorative element being fabricated of a resilient material and adapted to be snap-fitted onto the outside of said track element to provide the appearance of a continuous member.

9. In a door frame having jamb and lintel members, wherein said jamb members have a longitudinal channel, and a resilient trim member having a first edge with a bead along said first edge and a second edge adapted to press against an adjoining wall surface to provide a smooth junction therewith; said trim member being adapted to resiliently attach to the longitudinal channel.

* * * * *

UNITED STATES PATENT AND TRADEMARK OFFICE

CERTIFICATE OF CORRECTION

PATENT NO. : 5,038,538

DATED : 08/13/91

INVENTOR(S) : David P. Roxon

It is certified that error appears in the above-identified patent and that said Letters Patent is hereby corrected as shown below:

ON THE TITLE PAGE:

Item [30], Foreign Application Priority Date should be --Oct. 6, 1988--.

ABSTRACT

Line 3, "that receive spaced" should read --that receives spaced--.

Line 4, "the said" should read --the said slot--.

Line 6, "the frame member" should read --the frame members--.

COLUMN 3

Line 36-37, "attaching screws 13,14" should read --attaching screws 17, 18--.

Line 39-40, "screws 13,14" should read --screws 17,18--.

COLUMN 4

Line 3, "striker plate" should read --strike plate--.

Line 7, "striker plate" should read --strike plate--.

Line 42, "striker plate" should read --strike plate--.

Line 45, "striker plate" should read --strike plate--.

COLUMN 6

Claim 7, line 17, "axis of the jam" should read --axis of the jamb--.

UNITED STATES PATENT AND TRADEMARK OFFICE

CERTIFICATE OF CORRECTION

PATENT NO. : 5,038,538

DATED : August 13, 1991

INVENTOR(S) : David P. Rozon

It is certified that error appears in the above-indentified patent and that said Letters Patent is hereby corrected as shown below:

Claim 7, line 17, "axis of the jam" should read --axis of the jamb--.

Signed and Sealed this

Twentieth Day of July, 1993

*Attest:*

Michael K. Kirk

MICHAEL K. KIRK

*Attesting Officer*

*Acting Commissioner of Patents and Trademarks*